US008030231B2

(12) United States Patent
Lange et al.

(10) Patent No.: US 8,030,231 B2
(45) Date of Patent: Oct. 4, 2011

(54) ABSORBENT PERSONAL CARE AND/OR CLEANSING PRODUCT FOR COSMETIC AND/OR DERMATOLOGICAL APPLICATIONS COMPRISING AT LEAST ONE ABSORBENT SHEET

(75) Inventors: Rainer Lange, Bad Honnef (DE); Pietro Rosato, Leverkusen (DE); Astrid Wersuhn, Paris (FR)

(73) Assignee: Johnson & Johnson GmbH (DE)

( * ) Notice: Subject to any disclaimer, the term of this patent is extended or adjusted under 35 U.S.C. 154(b) by 0 days.

(21) Appl. No.: 11/176,828

(22) Filed: Jul. 7, 2005

(65) Prior Publication Data

US 2006/0019571 A1 Jan. 26, 2006

(30) Foreign Application Priority Data

Jul. 9, 2004 (EP) ..... 04016191

(51) Int. Cl.
*D04H 3/10* (2006.01)
*B32B 27/02* (2006.01)
*B32B 27/04* (2006.01)

(52) U.S. Cl. ..... 442/405; 442/118; 442/402; 442/403; 442/415; 442/416; 442/123

(58) Field of Classification Search ..... None
See application file for complete search history.

(56) References Cited

U.S. PATENT DOCUMENTS

| | | | | |
|---|---|---|---|---|
| 4,775,582 | A | 10/1988 | Abba et al. | |
| 5,094,690 | A | 3/1992 | Zikeli et al. | |
| 5,130,073 | A * | 7/1992 | Meirowitz et al. | 264/129 |
| 5,350,625 | A | 9/1994 | Peterson et al. | |
| 5,605,740 | A | 2/1997 | Tomiyama et al. | |
| 5,626,571 | A | 5/1997 | Young et al. | |
| 5,702,992 | A * | 12/1997 | Martin et al. | 442/123 |
| 5,928,973 | A * | 7/1999 | Daniel et al. | 442/407 |
| 5,964,742 | A | 10/1999 | McCormack et al. | |
| 6,569,828 | B1 | 5/2003 | Thomas et al. | |
| 6,699,922 | B2 | 3/2004 | Birnbrich et al. | |
| 2002/0168911 | A1 * | 11/2002 | Tonner | 442/405 |
| 2003/0119395 | A1 * | 6/2003 | Brooks | 442/96 |
| 2004/0170836 | A1 * | 9/2004 | Bond et al. | 428/398 |
| 2005/0112980 | A1 * | 5/2005 | Strandqvist et al. | 442/416 |
| 2005/0137547 | A1 * | 6/2005 | Didier et al. | 604/375 |

FOREIGN PATENT DOCUMENTS

| | | | |
|---|---|---|---|
| DE | 199 17 275 | B4 | 4/1999 |
| EP | 0750062 | B1 | 12/1996 |
| EP | 1 372 599 | B1 | 1/2004 |
| JP | 09-228212 | A | 9/1997 |
| JP | 09-228213 | A | 9/1997 |
| JP | 10-037055 | A | 2/1998 |
| JP | 10-077560 | A | 3/1998 |
| JP | 10-280261 | A | 10/1998 |
| JP | 2002/065497 | A | 3/2002 |
| WO | 96/13071 | A | 5/1996 |
| WO | 96/33303 | A | 10/1996 |
| WO | 97/00351 | A | 1/1997 |
| WO | 98/42898 | A | 10/1998 |
| WO | 02/31245 | A | 4/2002 |
| WO | 03/022116 | A | 3/2003 |
| WO | WO 03/022318 | A1 | 3/2003 |
| WO | WO 03/031557 | A1 | 4/2003 |
| WO | 03/095868 | A | 11/2003 |

OTHER PUBLICATIONS

EP Search Report dated Jan. 25, 2005 for EP 04 01 6191.1.
Tencel, Web Bonding—Needling, Mar. 1999, vol. 4, p. 3, Acordis Lyocell, Derby, United Kingdom.
Tencel for Needlebonding, Issue 4, Idea 04, Derby, United Kingdom.

* cited by examiner

*Primary Examiner* — Jenna-Leigh Johnson

(57) ABSTRACT

The present invention relates to an absorbent personal care and/or cleansing product for cosmetic and/or dermatological applications comprising at least one non-woven absorbent sheet comprising 10 to 100 wt. % lyocell fibers and 0 to 90 wt. % of at least one other natural, man-made natural and/or synthetic fiber, wherein the lyocell fiber has a fiber titer in the range from 0.5 to 3.5 dtex, wherein the absorbent sheet has a basis weight in the range from 20 to 500 g/m$^2$, and a tensile strength in the range from 5 to 1000 N/5 cm in machine direction and in cross direction. Further, the present invention relates to the use of said absorbent product as puffs, pads, wipes, tissues, towels, toweletts, sponges, brushes, cotton balls, gloves, mitts, cotton tip swabs or as a part thereof in cosmetic and/or dermatological applications, in particular as a basis onto which a cosmetic composition and/or dermatological cleansing and/or skin care composition, in particular in the form of a lotion, is being placed and/or into which said composition is being impregnated.

12 Claims, No Drawings

ABSORBENT PERSONAL CARE AND/OR CLEANSING PRODUCT FOR COSMETIC AND/OR DERMATOLOGICAL APPLICATIONS COMPRISING AT LEAST ONE ABSORBENT SHEET

FIELD OF THE INVENTION

The present invention refers to an absorbent personal care and/or cleansing product for cosmetic and/or dermatological applications as well as to the use of this absorbent product as a basis, e.g. a pad, wipe, towel, towelette, or tissue onto which a cosmetic and/or dermatological cleansing and/or skin care composition can be placed.

BACKGROUND OF THE INVENTION

Absorbent sheet products have become very popular for personal care applications for both adults and babies. Examples include face or body cleansing wipes, wipes for skin treatment, and skin conditioning wipes. These wipes or pads are nowadays commonly used to apply skin care compositions or make-up to the skin as well as for the removal of, for example, feces, urine or make-up.

In order to achieve such products which are well accepted by the consumer high standards, for example, in terms of softness, absorption and mechanical strength have to be met. Especially when used for make-up removal in rather sensitive areas like the area around the eyes the customer is very critical in the choice of products. It is, for example, immediately noticed if a pad or wipe lacks softness. Also, it is considered to be disadvantageous if an absorbent substrate tends to fray or fuzz as is for example the case with dabbers. Nevertheless, pieces of non-woven or cotton wool are still frequently used as a basis for make-up removal lotions.

In skin caring or cleansing operations active ingredients are usually not directly applied to the skin but with the use of pads or wipes to insure a more regular distribution. Also, the fingers are kept free of any oily lotions. Skin cleansing operations usually require pads and wipes which regularly take up soilage or make-up. In all cases the pad material should not irritate the skin even when repeatedly used. In addition, the absorbent capacity should meet high standards. In the recent years major efforts have been spent to improve the softness and absorbency characteristics of wipe and pad materials.

Initially, wet wipe products were made of traditional non-woven materials based on paper making technology (pulp based products). These products although accepted suffer in the softness of the fabric material. The introduction of the spunlacing non-woven technology offers products that compared to traditional paper based products are superior in terms of softness and strength. This is mainly due to the use of long soft fibers such as the rayon and PET-PP or mixtures of these fibers in the spunlacing process and also to the fact that during the spunlacing process no binder is added to the fabric.

However, even with these products, especially having higher basis weights, e.g. of about 80 g/m$^2$ or more, it is difficult to maintain the original structure of the wipe when impregnated with, for example, soilage or lotions. Ordinary pads usually collapse upon impregnation with these compounds thereby losing their absorbency, strength and softness characteristics.

Hence there is still a need for absorbent pads or wipes for cosmetic and/or dermatological applications. As becomes apparent in the following there have been several attempts to remedy the deficiencies of existing cosmetic or dermatological wipes and pads.

According to JP 2003095868 A a make-up wipe when comprising a non-woven fabric which contains ultra-fine fibers having a single fiber fineness of less than 0.5 dtex should be capable of efficiently removing a cosmetic without irritating the skin. The ultra-fine fibers have to occupy around 20% of the surface area of the non-woven fabric.

According to U.S. Pat. No. 5,626,571 the softness of non-woven webs or fabrics can be improved by a mechanical post-treatment, for example, by incrementally stretching a non-woven web. This can be achieved by employing opposed pressure applicators having three-dimensional surfaces which at least to a certain degree are complementary to one another, or by permanently stretching an inelastic base non-woven in the cross-machine direction. However, these non-woven fabrics still exhibit a relatively low abrasion resistance and tend to fuzz during application. This disadvantage can according to WO 02/31245 be overcome with a non-woven web having a consolidation area of at least 30% which is obtained by thermal bonding. With this modification the softness of the web should not be affected.

In addition, bond patterns have been utilized to improve strength abrasion resistance in non-woven fabrics while maintaining the softness as for example disclosed in U.S. Pat. No. 5,964,742.

Wipes having an improved softness which are less harsh on the skin compared to woven cloth or paper based pads and which are stronger than cotton based non-woven wipes shall according to EP 750 062 A1 be provided by non-woven webs having a basis weight of from 20 to 130 g/m$^2$. These wipes have to exhibit a specific coefficient of friction and have to be produced by hydroentangling or needlepunching.

In WO 03/022116 a cosmetic sheet product for skin applications is disclosed which has high absorbent capacity for active agents, good releasability of absorbed active agents and a good combination of softness and strengths. This soft non-woven fibrous cosmetic wipe material has to contain a non-woven fibrous layer having a z-direction loft from the backing of at least 0.5 mm where the non-woven fibrous layer material is bonded to a backing layer. This z-direction loft is formed by arcuate portions between areas of bonding of the non-woven layer to the backing which arcuate portions comprise from 20 to 99% of the wipes cross-sectional wiping area. Such a wipe can be formed from a broad range of non-woven fabrics and fibers and is not any longer limited to the use of conjugate fibers having at least two crimps per inch or to non-wovens that are bonded at all fiber cross-over points as required by U.S. Pat. No. 5,605,749. According to this latter document to obtain a pad for personal or industrial use which exhibits good compression resilience, high physical strength and abrasion resistance rather complex and specific requirements have to be met.

According to U.S. Pat. No. 4,775,582 also meltblown non-woven wipes are suitable for personal care uses.

EP 750 062 A1 requires the basis weight of non-woven webs to be from 20 to 130 g/m$^2$ and to be produced by hydroentangling or needlepunching in order to be useful as skin cleansing wipes.

From U.S. Pat. No. 5,928,973 a non-woven needlepunch fabric can be derived consisting of 60 to 90 wt.-% lyocell fiber having a length of 2.54 to 15.32 cm, 10 to 40 wt.-% polyester fiber having a length of 2.54 to 15.32 cm and 0 to 30 wt.-% of other textile fibers, wherein the lyocell fibers have a denier in the range of 0.75 to 6 prior to fibrillation and wherein the fabric has been formed by subjecting the fibers to carding, cross-lapping and needlepunching. Particularly preferred fibers comprise crimped lyocell and polyester fibers. However, the fabrics according to U.S. Pat. No. 5,928,973 are still rather harsh and tight and are lacking a sufficient degree of softness paired with a required degree of bulkiness. Fabrics as disclosed in U.S. Pat. No. 5,928,973 are therefore mainly used in automotive or battery applications, as for example described in WO 96/13071.

Also for floor cleaning wipes non-woven substrates are frequently used. In WO 03/050230 such a floor cleaning wipe is described the water-insoluble substrate of which has been impregnated with a liquid composition which is not an emulsion. The water-insoluble substrate consists of two layers wherein the first layer is a polyester non-woven fabric and the second layer is made from a needlepunched cellulose non-woven fabric.

U.S. Pat. No. 6,569,828 B1 discloses a cleaning wipe for dish washing applications wherein the water insoluble substrate consists of a top layer of coarse fibers, for example, made from polypropylene fibers, an absorbent center layer made from cellulose fibers and a bottom layer of fine fibers, for example, made of polyester fibers. Only the center absorbent layer is impregnated with a cleansing composition which also comprises a water-soluble cellulosic polymer besides a surfactant, a solubilizing agent and a preservative.

The cosmetic wipe described in WO 02/072052 is impregnated with an oil-in-water emulsion which can also be a PIT emulsion containing a $C_{12-30}$ carboxylic acid mono- or diglyceride. The sheet material is preferably made from non-wovens such as wood pulp, polyolefin, polyester or polyamide fibers. Preferably, a mixture of cellulose pulp and a binding material is employed. This non-woven sheet material can be made by a variety of processes such as airlaying, wetlaying or carding. The wipes according to WO 02/072052 should be soft and also provide a softer feel after the application of the wipe without the need to have to add specific fabric softeners to either the finished product or the fibers used as raw materials.

DE 199 17 275 B4 is about a non-woven cleansing wipe made from microstaple fibers and absorbent secondary staple fibers wherein the microstaple fibers are multi-component split fibers from at least two different polymers and wherein the secondary staple fibers are made from viscose lyocell fibers according to the chemical fiber spinning process. In case such a cleansing wipe consists of more than one non-woven layer these layers can be joined by entanglement, lamination or needlepunching. These cleansing wipes exhibit a high abrasion resistance as well as a high absorbent capacity for soilage and also a high strength.

The problem related to conventional non-woven wipe materials still is that they are not well suited to maintain their structure and do collapse when impregnated with lotions or wetted. In addition, it would be desirable to have access to a non-woven which does not loose its soft touch sensation when rubbed on the skin without the need to use large amounts of material.

The object of the present invention has been to provide an absorbent product, e.g. a pad, suitable for cosmetic applications even with rather sensitive areas such as the skin around the eye which is soft and bulky, does not irritate the skin, takes up make-up efficiently and is suited to apply cosmetic and dermatologic lotions to the skin without the risk that the fiber will ravel out, and which maintains its original structure when impregnated with said lotions or when being wetted or having taken up removed make-up.

A further object of the present invention has been to provide an absorbent product which is superior in retaining fluids, such as cosmetic and dermatological lotions, and which in particular holds a liquid such as the aforementioned lotion after having been disposed onto or impregnated into the absorbent product whereby this liquid is prevented from a downward movement due to gravity.

SUMMARY OF THE INVENTION

The present invention is concerned with an absorbent personal care and/or cleansing product for cosmetic and/or dermatological applications comprising at least one non-woven absorbent sheet comprising 10 to 100 wt. % lyocell fibers and 0 to 90 wt. % of at least one other natural, man-made natural and/or synthetic fiber, wherein the lyocell fiber has a fiber titer in the range from 0.5 to 3.5 dtex, wherein the absorbent sheet has a basis weight in the range from 20 to 500 g/m$^2$, and a tensile strength in the range from 5 to 1000 N/5 cm in machine direction and in cross direction.

Preferably, the absorbent sheet comprises 30 to 90 wt. %, in particular 40 to 80 wt. %, lyocell fibers and 10 to 70 wt. %, in particular 20 to 60 wt.-%, other natural, man-made natural and/or synthetic fibers, in particular synthetic fibers.

In another preferred embodiment the absorbent sheet comprises 10 to 50 wt. %, in particular 10 to 40 wt. %, lyocell fibers, 10 to 40 wt. % natural fibers, preferably fibers made from cotton, and 10 to 80 wt. %, in particular 20 to 80 wt. %, man-made natural and/or synthetic fibers.

According to another aspect of the present invention an absorbent product is provided wherein at least one section of the natural, man-made natural and/or synthetic fiber comprises at least one, in particular permanent, hydrophilic surface.

Also, it is preferred that the absorbent sheet comprises 10 to 90 wt. %, in particular 30 to 70 wt. %, natural, 10 to 90 wt. %, in particular 20 to 60 wt. %, man-made natural and/or synthetic fibers which comprise at least a section having at least one, in particular permanent, hydrophilic surface, and 0 to 50 wt. %, in particular 10 to 30 wt. %, polyester fibers.

In certain embodiments of this invention the absorbent sheet has been made by use of carding being the web forming technique and needlepunching being the web bonding technique and wherein the carded fibers have been cross-lapped prior to needlepunching.

It is particularly preferred that the synthetic fiber comprises a polyester fiber, in particular a PET fiber.

In still further specific embodiments at least a portion of the fibers of the absorbent sheet exhibit a fiber titer of below 2.5 dtex, preferably below 2.0 dtex and more preferably equal or below 1.3 dtex.

According to another preferred embodiment of this invention the absorbent sheet has a thickness in the range from 0.4 to 5 mm, preferably from 1.5 to 3 mm and more preferably from 1.8 to 2.8 mm.

In a particular preferred embodiment the absorbent sheet comprises 50 to 65 wt. % lyocell fibers and 35 to 50 wt. % polyester fibers both having a fiber titer of 1.7 dtex, preferably 1.4 dtex, or lower.

According to another preferred provision of the present invention the basis weight of the absorbent sheet is in the range from 30 to 400 g/m$^2$, preferably in the range from 50 to 250 g/m$^2$, and more preferably in the range from 150 to 200 g/m$^2$.

In a further aspect the tensile strength of the absorbent sheet is in the range from 20 to 800 N/5 cm, preferably from 80 to 400 N/5 cm, and more preferably from 100 to 250 N/5 cm, in machine direction as well as in cross direction.

According to another embodiment the elongation of the absorbent sheet is in the range from 20 to 160%, preferably in the range from 70 to 120%, and more preferably in the range from 80 to 100%.

A further development provides for the bending torque of the absorbent product, in particular of the absorbent sheet, to be equal or below 0.20, preferably 0.17, and more preferably equal or below 0.15 g×cm, according to the Kawabata test, in particular both in machine direction and in cross direction.

It is particularly preferred that at least one surface of at least one absorbent sheet comprises at least one three-dimensional surface pattern, in particular at least one embossment.

A three-dimensional surface pattern of the absorbent product can for example be obtained by the needle punching technique. Due to a variation in, for example, needle density per area, needling depths and intensity and/or needle size and/or shape a pattern of raised and lowerd regions can be obtained. Furthermore, such a structuring or patterning of the surface of the absorbent product can also be obtained by use of calendar roles or other known conventional embossment techniques.

In a preferred embodiment of the present invention the absorbent sheet has a density of below 0.09 g/cm$^3$.

Furthermore, the absorbent product can take the form of a cosmetic and/or dermatological pad, towel, towelette, tissue or wipe or a part thereof.

In another preferred embodiment the absorbent product according to the present invention further comprises a cosmetic, dermatological, cleansing and/or skin care composition.

According to another aspect an absorbent product assembly has been found which comprises two, three or more absorbent products according to the present invention which are at least partially directly or indirectly superimposed onto each other, in particular arranged in at least one stack or on a role.

DETAILED DESCRIPTION OF THE INVENTION

Whenever used in this description and in the claims, any percentage is weight by weight (w/w) unless stated otherwise.

The present invention is concerned with an absorbent personal care and/or cleansing product for cosmetic and/or dermatological applications which comprises at least one non-woven absorbent sheet as specified herein. The non-woven absorbent sheet comprises about 10 to about 100 wt.-%, preferably about 30 to about 90 wt.-%, and more preferably about 40 to about 80 wt.-% lyocell fibers and about 0 to 90 wt.-%, preferably about 10 to about 70 wt.-%, and more preferably about 20 to 60 wt.-%, of at least one other natural, man-made natural and/or synthetic fiber.

Particularly favorable results can, for example, be obtained when the non-woven absorbent sheet comprises about 50 wt. % lyocell fibers and about 50 wt. % polyester fibers, in particular PET fibers, especially in terms of softness, strength and bending characteristics.

Lyocell is the name for a generic fiber approved by the Federal Trade Commission in 1996. Lyocell can be characterized as a so called man-made fiber. It is made from wood pulp—and thus has a cellulosic basis—by extrusion of a solution of cellulose in an aqueous tertiary amine N-oxide, for example N-methylmorpholine N-oxide, through a suitable die into an aqueous coagulating bath to produce an assembly of filaments ("solvent spinning"). These filaments are washed with water to remove the solvent and are subsequently dried. According to, for example, U.S. Pat. No. 5,094,690 cellulose is suspended in an aqueous solution of the tertiary amine oxide and is then heated to temperatures between 90 to 120° C. with stirring.

Lyocell is more similar to cotton than it is to rayon in many ways. However, like other cellulosic fibers, e.g. viscose, it is breathable, absorbent, and generally comfortable to wear. Lyocell has a high wet strength.

Lyocell fibers can, for example, be purchased from Acordis Cellulosic Fibers under the trade name Tencel or from Lenzing Fibers under the trade name Lenzing lyocell.

In general, natural materials useful in the present invention encompass silk, keratine and cellulosic fibers. Suitable natural fibers which can be used in combination with lyocell fibers can for example be selected from the group consisting of cotton, wool, silk, linen, sisal, hemp, ramie, flax and jute and mixtures thereof.

Suitable man-made natural fibers can, for example, be selected from the group consisting of regenerated cellulose, in particular viscose, cupro and/or modal, polylactide acid, and alginate, and mixtures thereof. Particularly preferred is regenerated cellulose like viscose.

Non-limiting examples of synthetic fiber materials useful in the present invention include those selected from the group consisting of acetate fibers, aramide fibers, polyamide fibers, e.g. nylons, polyester fibers, e.g. polyethylene terephthalate fibers (PET), polyolefin fibers, e.g. polypropylene and polyethylene fibers, polyvinyl alcohol fibers, polyurethane fibers or foams, and mixtures thereof. Further suitable synthetic fibers include bi- or tricomponent fibers such as PE/PET- or PP/PE fibers. These fibers can for example be so-called core-sheath-, side-by-side- or island-in-the-sea type fibers.

Preferred embodiments of the absorbent product according to the invention comprise apart from lyocell fibers also fibers at least a section of which exhibits an, in particular permanent, hydrophilic surface. Such an, in particular permanent, hydrophilic surface can for example be obtained by coating natural, natural man-made or synthetic fibers as described above, e.g. polyamide fibers, e.g. nylons, polyester fibers, e.g. polyethylene terephthalate fibers (PET), polyolefin fibers, e.g. polypropylene and polyethylene fibers, polyvinyl alcohol fibers, bi- or tricomponent fibers such as PE/PET- or PP/PE fibers, viscose fibers, cotton fibers, wool fibers, silk fibers, linen fibers, sisal fibers, hemp fibers, ramie fibers, flax fibers and jute fibers and mixtures thereof, with an, in particular permanent, hydrophilic finish.

In particular a permanent hydrophilic finish can for example be obtained according to WO 96/33303 by applying a first spin finish comprising at least one hydrophilic lubricant which contains polydiorganosiloxane to which after stretching a second spin finish comprising at least one cationic antistatic agent which also comprises polydiorganosiloxane is applied. Also, following the teaching of WO 97/00351 a fiber having a permanent hydrophilic surface finish can be obtained by use of an aqueous dispersion which comprises a hydrophilic copolyester having repeating segments of a polyoxyethylene diester and a polyalkylene diester and a polypropylene oxide polymer capped on one or both ends with an alkyl or ester group wherein said polymer has more than four propylene oxide units and an average molecular weight of at least about 300. In addition, a composition for a permanent hydrophilic finish is disclosed which comprises a mixture of an organic solvent, a hydrophilic copolyester having repeating segments of a polyoxyethylene diester and a polyalkylene diester, and a polypropylene oxide polymer capped on one or both ends with an alkyl or ester group, wherein said polymer has more than four propylene oxide units and an average molecular weight of at least about 300. Furthermore, WO 97/00351 discloses a dispersion comprising a hydrophilic copolyester having repeating segments of a polyoxyethylene diester and a polyalkylene diester, and a polypropylene glycol having an average molecular weight of more than 1100. In addition WO 97/00351 discloses a mixture of an organic solvent, a hydrophilic copolyester having repeating segments of a polyoxyethylene diester and a polyalkylene diester, and a polypropylene glycol having an average molecular weight of more than 1100.

In addition or alternatively synthetic fiber materials are preferred wherein, after their manufacture, hydrophilic compounds being distributed within the fiber material migrate to the surface of these fibers to form an, in particular permanent, hydrophilic fiber finish. For example, polyester fibers, in particular PET fibers, polypropylene fibers and bicomponent fibers as described above are particularly preferred as the basis or core material for such, in particular permanent, hydrophilic surfaces.

According to WO 98/42898 a permanent hydrophilic fiber surface can be obtained by processing, e.g. extruding, calendaring or injection molding, a mixture comprising a polyolefin, a migratable amphiphile such as compounds having polar residues, e.g. carboxyl, hydroxyl, amino, oxazolin, imidazolin, epoxide, isocyanate, ester, ether, amide, alkanol amine and alkanol amide groups, and a transition metal compound such as selected from the group consisting of lead, nickel, zirconium, chromium, titanium and tin salts. Also, from U.S. Pat. No. 6,699,922 B2 non-woven fabrics having a permanent hydrophilic surface can be obtained from synthetic fibers comprised of a polymer containing an effective amount of a di-$C_{10-12}$ fatty acid ester of polyethylene glycol.

Suitable polyester fibers having a permanent hydrophilic finish are, for example, commercially available under the trade name Hydrofix® available from DuPont. Suitable polypropylene fibers having a permanent hydrophilic finish are, for example, commercially available under the trade name Hyentangle WA available from Fiber Visions.

In particular, essentially the entire surface of these surface treated natural, natural man-made and synthetic fibers is provided with an, in particular permanent, hydrophilic finish.

The aforementioned fibers having at least on a section an, in particular permanent, hydrophilic surface can either be blended with lyocell fibers alone or can be blended with lyocell fibers and any of the aforementioned natural, natural man-made or synthetic fibers or any combination thereof to form an absorbent sheet according to the present invention. These absorbent products which comprise fibers which exhibit an, in particular permanent, hydrophilic surface are particularly suited to prevent any liquids disposed onto or impregnated into the absorbent product from migrating downwards through the absorbent product due to gravity. Especially those absorbent products according to the invention which besides lyocell fibers also comprise fibers which exhibit a permanent hydrophilic surface are preferred. Such a fiber having a permanent hydrophilic surface usually retains its hydrophilic character even upon several exposures to moisture or water washes. For example, the permanent character of a hydrophilic surface or coating can be determent according to EDANA standard no. ERT 150.2-93. Also, in modified EDANA method can be employed, as for example described in WO 96/33303. The modification compared to the standard method recites in the fact that the strike-through measurement is performed three times on precisely the same spot on the absorbent product. The absorbent product is neither dried nor wiped off in any way between the test runs. After three sequences of three test runs each the mean and standard deviations of the measurements are calculated for each test run. In order to be classified as a permanent hydrophilic surface/coating the third strike-through time should be at the most 20 sec., preferably at the most 10 sec., and more preferably at most 5 sec. Alternatively, the permanent character of a hydrophilic surface can also be determined by its re-wetting properties, e.g. measured by EDANA method ERT 151.0-93, i.e. the quantity of fluid (in grams) is measured which flows back into a superposed dry filter paper when a thoroughly wetted fleece is loaded by a 4 kg weight. Also, absorbency and retaining characteristics can be determined by use of the EDANA 10.3-99 test. With the latter test the absorbent products of the present invention, in particular in the form of pads or wipes, exhibit an absorbance and retaining power of up to 1200 wt.-% and more with water, and up to 1500 wt.-% and more with, in particular stable, oil/water lotions not showing a phase separation on a macroscopic scale at least upon application to the absorbent product.

Absorbent products according to the invention which exhibit a permanent hydrophilic surface are especially suited to retain a liquid or lotion which has been applied to these products at the desired area within this absorbent product. Even when for example treated with a skin care composition and being arranged in a stack of superimposed individual absorbent products the skin care composition will be maintained within its respective absorbent article and will not migrate downwards whereby it can be prevented that those absorbent articles being at the top part of the stack will dry out and the absorbent articles at the bottom part of the stack will be drenched with skin care lotion after a while.

A permanent hydrophilic surface in the sense of the present invention can be defined in such a way that its hydrophilic character does not vanish after repeated exposures to moisture or water washes.

The absorbent product according to the invention can be mono or multi-layered. For example, it can be composed of two, three or more non-woven absorbent sheets as described herein. In addition or alternatively the non-woven absorbent sheet itself can be mono or multi-layered, and can, for example, comprise two, three or more individual sheets.

Particularly preferred are non-woven materials that have a web structure of fibrous or filamentous nature in which fibers or filaments are distributed randomly or with a certain degree of orientation. Non-woven web structures can for example be obtained by airlaying or certain wetlaying processes. At least partially oriented non-woven web structures are accessible via other wetlaying techniques or carding processes. In general, the absorbent sheet can be made by use of web forming techniques selected from the group consisting of carding, spunbonding, meltblowing, airlaying and wetlaying. It is particularly preferred that the non-woven material from which the final absorbent sheet is prepared exhibits at least a certain degree of orientation. Preferably, such an oriented non-woven material is obtained via carding processes.

Preferably, the fibers of the carded non-woven web material are oriented predominantly in a machine direction, and not in cross direction.

Multi-layered sheet materials are herein defined as comprising two or more layers of the same or different non-woven material and/or layers obtained by different techniques, as long as one absorbent sheet complies to the limits of present claim 1. Most preferably, this non-woven absorbent sheet represents the top and/or bottom layer of a multi-layered sheet material.

According to another aspect of the present invention multi-layered sheet materials can preferably be made by use of at least one web bonding techniques selected from the group consisting of needlepunching, resin bonding, chemical bonding, thermal bonding, hydroentanglement or a mixture thereof. Most preferred these multi-layered sheet materials are formed by use of hydroentanglement and/or needlepunching, that is adjacently aligned sheets/layers are joined by the aforementioned techniques.

With the hydroentanglement process usually a multitude of very fine water jets are applied to a non-woven substrate carried on a support. Instead of these water jets or simultaneously pressurized air jets can be used.

It is particularly preferred that the non-woven material is cross-lapped prior to the web forming process step. Cross-lapping is well known to a person skilled in the art. For example, the carded web material is moved forward and backwards when laid on a belt or carrier while its lower front portion is pulled perpendicular to this forward and backward movement whereby the web material overlaps in a z-like fashion.

With the use of needlepunching, for example with the aid of one or more needle looms, a web of loose fibers, e.g. a web of carded fibers, is converted into a coherent non-woven fabric. By needlepunching fibers are mechanically oriented through the web. The needles can be arranged on a needle tool, e.g. a needle board or loom, in a non-lined arrangement. In the needle punching step preferably at least one needle tool is used having in the range from about 50 to 300, preferably from about 70 to 250 and more preferably from about 90 to 110 needles per $dm^2$. In a preferred embodiment the strokes per minute, the number of needles per loom, the advance rate of the pad and in particular the degree of penetration of the needles is adjusted in such a way that as little as possible energy is imparted on the bed while still obtaining a bonded web system which does not delaminate, preferably without the use of a binder material.

It is has been found that by use of needlepunching a web of high strength can be obtained when using lyocell fibers which still is superior in terms of softness and bulkiness.

The lyocell fibers used with the absorbent product according to the present invention preferably have a fiber titer in the range from 0.5 to 3.4 dtex, preferably of below 2.5 dtex, more preferably below 2.0 dtex, even more preferably below 1.7 dtex and in particular below 1.4 dtex. It is particularly preferred when not only the lyocell fiber but also the natural, man-made natural and/or synthetic fibers used with the non-woven absorbent sheet comply to the same general and preferred fiber titer ranges.

In particular, the absorbent sheet of the absorbent product according to the invention has a basis weight in the range from 20 to 500 $g/m^2$, in particular from 30 to 400 $g/m^2$, more preferably in the range from 50 to 250 $g/m^2$, and in particular from 150 to 200 $g/m^2$.

Furthermore, the absorbent sheet exhibits a tensile strength in the range from 5 to 1000 N/5 cm in machine as well as in cross direction. Preferred values of tensile strength range from 20 to 800, preferably from 80 to 400 and more preferably from 100 to 250 N/5 cm.

The absorbent sheet exhibits an excellent mechanical strength, in particular the wet strength of this absorbent sheet is very satisfactory. The absorbent product according to the invention is therefore resistant to wet collapse and can absorb sufficient amounts of skin care compositions such as emulsions or lotions, or of removed make-up and/or debris without reducing the bulkiness of the sheet material.

It has been found that for a variety of applications a thickness of the absorbent sheet in the range from 0.4 to 5 mm is generally sufficient. Even with a thickness in the range from 1.5 to 3, and more preferably from 1.8 to 2.8 mm the sheet material creates a sensation of softness and bulkiness on the skin. It is therefore possible to achieve such sensations without the need of using excessive amounts of fibers, especially of lyocell.

The absorbent products of the present invention are superior in terms of softness and strength. In particular, the soft sensation of the absorbent material as such as well as the ease with which it can be bent contribute to a favorable impression when used on the skin either in dry form or after having been impregnated with a lotion. Absorbent products, in particular absorbent sheets being used with absorbent products, are most suited when having a bending torque of no more than 0.2 g×cm, preferably of no more than 0.17 g×cm, in particular of no more than 0.15 g×cm. It has been found that those absorbent products are especially superior in terms of softness which comply with the aforementioned bending torque ranges in the machine direction as well as in cross direction.

The bending torque in the meaning of the present invention is measured by use of a Kawabata KES-FB2 pure bending tester. The Kawabata bending test is part of the Kawabata system which is designed to measure basic mechanical properties of non-wovens and other web materials. With this test the bending torque is established by gathering the results of at least three samples and calculating the average from these test results. The sample's size is 8.9 cm×8.9 cm. Further, the calibration mass is 50 g, and the instrument sensitivity is equal to 5×1. The front moving jaw to rear moving jaw gap is set to 1 cm. There is no side orientation of the samples. There are four bending cycles per measurement. The cycle curvature is equal to $0\,cm^{-1}$ to $^{+2.5}\,cm^{-1}$ to $-2.5\,cm^{-1}$ to $0\,cm^{-1}$. The cycle rate is $0.5\,cm^{-1}$/sec, and the number of measurements is set to 8. The bending torque (g×cm) then represents the slope of the linear regression line between approximately $0.5\,cm^{-1}$ and $1.5\,cm^{-1}$ of the Moment (g×cm/cm) versus Curvature (1/cm curve).

In general, the absorbent personal care and/or cleansing product of the present invention can be used for a broad number of various applications, such a diapers, sanitary napkins, panty liners, baby wipes, cleansing wipes, wet wipes, bandages, medicinal dressings and the like.

As used herein with respect to non-woven webs the term "machine direction" refers to the direction of web travel as the non-woven web is produced, for example, on commercial non-woven manufacturing equipment. Likewise, the term "cross direction" refers to the direction of the plane of the web perpendicular to the machine direction.

As used herein, the term "basis weight" means the weight per unit area of the absorbent product, or the non-woven absorbent sheet. The units of basis weight are typically expressed in grams per square meter.

It has been surprisingly found that with the presently claimed absorbent products a highly advantageous pad material for cosmetic or dermatological applications is available. This sheet material creates a very soft feeling on the skin irrespective of whether it is dry or has been treated with a skin care composition, yet it is very tight and exhibits good mechanical strength allowing for a good grip. Also the beneficial bending characteristics of the absorbent sheet of the absorbent product contribute to its superior softness properties. Especially, even with rather thin sheet-like absorbent products according to the invention the fingers to be used for holding and moving the pad product are not felt on the skin. It is also highly beneficial that different from, for example, cotton wool pads the absorbent product of the present invention does not create any fluffs at all even on intense rubbing. Moreover, the absorbent product keeps its form and does not split in two or more parts or layers during use. Due to its softness and its mechanical strength make-up can be removed by use of the absorbent products in one step without the need to rub the skin. Accordingly, with the absorbent products of to the invention it can be prevented to drag on or damage sensitive skin like the area around the eyes. Therefore, it is the general impression that make-up, even waterproof make-up such as waterproof mascara, can be removed in a very gentle and soft fashion when using the absorbent product of the invention. Furthermore, no Tinting is observed with these products.

It has been also surprisingly found that with the absorbent products of the present invention any liquids or lotions applied thereto do not migrate through these products driven by gravity but are retained within these products at those depths originally taken upon impregnation even on storage for longer periods.

In the following, the preparation of an absorbent sheet of the absorbent product according to the invention is described in more detail.

60 wt.-% of a lyocell fiber of the company Lenzing and 40 wt.-% of a polyethylene terephthalate (PET) of the company Trevira have been blended prior to a carding step by which the fiber batts have been opened so that individual fibers are essentially free and also oriented in machine direction. Both the lyocell fiber and the PET fibers have a fiber titer of 1.3 dtex. Dtex refers to the weight of a fiber filament having the length of 10.000 m, i.e. 10.000 m of the above mentioned fibers weigh 1.3 g. The fibers were then carried over a roll to furnish a light non-woven layer having a depth of around 10 cm which has not been strengthened yet. This non-woven layer has been subjected to cross-lapping in a so called cross-lapper. Depending on the weight of the final product the non-woven layer is placed one, two or several times on top of each other in the cross-lapper. Simultaneously the layered non-woven material was pulled from its bottom end in a perpendicular direction resulting in a Z-like structure of the layered non-woven material which is drawn away from the cross-lapper. The cross-lapped non-woven material has been subjected to one or more needling units each having at least one needle board with around 100 needles per $cm^2$. Barbed needles have punched fibers into the pad and left the fibers entangled. At the end of the needlepunching process the strengthened non-woven sheet material was cut into, for example, pads or wipes. Depending on the strokes per minute, the number of needles per needle board and the degree of penetration of needles, to mention a few parameters, the softness of the resulting non-woven absorbent sheet can be adjusted.

In a similar manner as outlined above a non-woven absorbent sheet has been prepared comprising 20 wt.-% cotton fibers, 20 wt.-% lyocell fibers and 60 wt.-% PET fibers.

Furthermore, for comparative reasons sheet materials have been prepared according to the above outlined procedure using a) 70 wt.-% viscose fiber and 30 wt.-% PET fibers (both having a fiber titer of 1.7 dtex), b) 60 wt.-% cotton fibers and 40 wt.-% PET fibers (US cotton fine; PET 1.3 dtex) and c) 100 wt.-% cotton fibers (US cotton fine). The test results can be derived from the following table.

TABLE

| No. | Composition | Basis Weight ($g/m^2$) | Tensile strength machine direction N/5 cm | Tensile strength machine direction % | Tensile strength cross direction N/5 cm | Tensile strength cross direction % | Thickness (mm) | Absorption % |
|---|---|---|---|---|---|---|---|---|
| 1. | 60/40 Lyocell/PET (Extra soft) | 185 | 184.3 | 57.2 | 159.8 | 78 | 2.79 | 1583.0 |
| 2. | 60/40 Lyocell/PET | 185 | 232.7 | 52.9 | 192.3 | 81.7 | 2.43 | 1238.4 |
| 3. | 20/20/60 Cotton/Lyocell/PET | 192 | 109.7 | 45.9 | 74 | 78.6 | 2.46 | 1337.2 |
| 4. | 70/30 viscose/PET[1)] | 196 | 197.1 | 39.5 | 141.6 | 79.2 | 2.19 | 116.1 |
| 5. | 60/40 Cotton/PET[1)] | 192 | 109.7 | 45.9 | 74 | 78.6 | 2.46 | 1337.2 |
| 6. | 100% Cotton[1)] | 195 | 91.7 | 33.2 | 33.5 | 70.1 | 1.76 | 1096.0 |

[1)]not according to the invention

As can be derived from the above table although the absorbent products according to the invention exhibit a lower basis weight than the comparative sheet materials a higher tensile strength in machine direction as well as in cross direction can be obtained. Furthermore, although less material is needed thicker pads can be obtained. In addition, even with very thin sheets which are according to the invention a sensation of softness and bulkiness is achieved which cannot be obtained with conventional pad materials of similar thickness. Also, the absorbent products according to the invention are superior with respect to their absorption characteristics.

It is also a major benefit of the absorbent product of the present invention that it easily absorbs and retains high quantities of fluids or lotions, but that it is also capable of releasing sufficient amounts of skin care and/or cleansing compositions which have been impregnated into these products, in particular when also fibers having, in particular a permanent, hydrophilic surface are employed. Absorbency and retaining characteristics can for example be determined by use of the EDANA 10.3-99 test. With this test usually a 10 cm×10 cm fiber specimen is deposited in a liquid bath until saturated. Then, the specimen is held in a vertical orientation to let the liquid drip off for 2 minutes, after which the weight of the soaked specimen as well as the amount of absorbed liquid is determined.

For example, when subjecting a 10 cm×10 cm fiber pad having a basis weight of 185 $g/m^2$ and a thickness of 2.43 mm according to Example no. 2 of the aforementioned Table to an EDANA 10.3-99 test about 1200 wt.-% of water and about 1200 to 1300 wt.-% of a lotion are retained. The lotion will be described hereinafter. Moreover, when subjecting a 10 cm×10 cm fiber pad according to the invention having a basis weight of about 185 $g/m^2$ and a thickness of about 2.4 mm and comprising 50 wt.-% lyocell fibers (1.3 dtex), 30 wt.-% PET fibers (1.3 dtex), and 20 wt.-% polypropylene fibers having a permanent hydrophilic surface (HyEntangle WA; 1.7 dtex) and which has been prepared as described for the pads of the above Table to the aforementioned EDANA test about 700 to 800 wt.-% of water and about 1400 to 1500 wt.-% of a lotion as described hereinafter are retained. And, when subjecting a 10 cm×10 cm fiber pad according to the invention having a basis weight of about 185 $g/m^2$ and a thickness of about 2.4 mm and comprising 50 wt.-% lyocell fibers (1.3 dtex), 30 wt.-% PET fibers (1.3 dtex), and 20 wt.-% PET fibers having a permanent hydrophilic surface (Hydrofix PET; 1.7 dtex) and which has been prepared as described for the pads of the above Table to the aforementioned EDANA test about 1000 to 1100 wt.-% of water and about 1400 wt.-% of a lotion as described hereinafter are retained. The aforementioned stable lotion used with the EDANA test has been obtained by mixing (based on w/w) water (73.395%); tetrasodium EDTA (0.08%); coco-glucoside (0.275%); phenoxyethanol (0.9%); a preservative which comprises butyl paraben, ethyl paraben, isobutyl paraben, methyl paraben and propyl paraben (0.3%) (commercially available under the trade name Nipastat); a PIT emulsion (10%) which comprises water, ceteareth-12, ceteareth-20, cetearyl alcohol, cetearyl isononanoate, cetyl palmitate, glycerine and glycerol stearate (also commercially available under the trade name Emulgade CM; Ceteareth-12 is ethoxylated cetostearyl (or cetearyl) alcohol having 12 ethoxy units. Ceteareth-20 is ethoxylated cetostearyl alcohol having 20 ethoxy units); cyclopentasiloxane (10%); isohexadecane (3%); glycerine (2%) and citric acid (0.05%).

Obviously, numerous modifications and variations of the present invention are possible in light of the above teachings. It is therefore to be understood that within the scope of the appended claims, the invention may be practiced otherwise than as specifically described herein.

The invention claimed is:

1. An absorbent personal care product comprising a personal care composition and at least one non-woven absorbent sheet comprising 10 to 40 wt. % lyocell fibers, 10 to 40 wt. % natural fibers and 10 to 80 wt. % synthetic fibers, both the lyocell fibers and the synthetic fibers having a fiber titer of below 1.4 dtex, wherein the absorbent sheet has a basis weight in the range from about 150 to about 400 g/m2, a density of below about 0.09 g/cm$^3$, a thickness in the range of from about 1.5 to about 5 mm and a tensile strength in the range from 5 to 1000 N/5 cm in machine direction and in cross section wherein the absorbent sheet has been made by use of carding being the web forming technique and needlepunching being the web bonding technique and wherein the carded fibers have been cross-lapped prior to needlepunching and wherein at least one section of said synthetic fibers is coated with a permanent hydrophilic finish such that the entire surface of said synthetic fibers is provided with said permanent hydrophilic finish.

2. The absorbent product according to claim 1 wherein the absorbent sheet has a thickness in the range from 1.5 to 3 mm.

3. The absorbent product according to claim 1 wherein the basis weight of the absorbent sheet is in the range from about 150 to about 200 g/m$^2$.

4. The absorbent product according to claim 1 wherein the tensile strength of the absorbent sheet is in the range from 20 to 800 N/5 cm.

5. The absorbent product according to claim 1 wherein the elongation of the absorbent sheet is in the range from 20 to 160%.

6. The absorbent product according to claim 1 wherein the bending torque of the absorbent sheet, is equal or below 0.20 according to the Kawabata test, in both in machine direction and in cross direction.

7. The absorbent product according to claim 1 wherein at least one surface of at least one absorbent sheet comprises at least one three-dimensional surface pattern embossment.

8. The absorbent product according to claim 1 wherein the absorbent sheet has a thickness in the range of from about 1.8 to about 2.8 mm.

9. The absorbent product according to claim 1 wherein said product is a cosmetic and/or dermatological pad, towel, towelette, tissue or wipe or a part thereof.

10. The absorbent product according to claim 1 wherein said personal care product is selected from a cosmetic composition, a dermatological composition or a skin cleansing composition.

11. A cosmetic or dermatological product comprising an absorbent product of claim 1 in the form of a puff, pad, wipe, tissue, towel, towelette, sponge, brush, cotton ball, glove, mitt, cotton tip swab or a part thereof, said absorbent product having a composition selected from the group consisting of cosmetic, dermatological, cleansing, skin care compositions, and combinations of two or more thereof, thereon or impregnated therein.

12. The absorbent product according to claim 1 wherein the synthetic fibers are polyester fibers.

* * * * *